US006932257B1

(12) United States Patent
Guerrero

(10) Patent No.: US 6,932,257 B1
(45) Date of Patent: Aug. 23, 2005

(54) PORTABLE HANDHELD ARTICLE DISPENSER HAVING AN ERGONOMIC SNUG GRIP BODY

(76) Inventor: Rick Frank Guerrero, 1929 Pepper Dr., Altadena, CA (US) 91001

( * ) Notice: Subject to any disclaimer, the term of this patent is extended or adjusted under 35 U.S.C. 154(b) by 18 days.

(21) Appl. No.: 10/725,754

(22) Filed: Dec. 2, 2003

(51) Int. Cl.[7] ..... B26F 3/02
(52) U.S. Cl. ..... 225/39; 225/80
(58) Field of Search ..... 225/39, 46, 77, 225/80, 79

(56) References Cited

U.S. PATENT DOCUMENTS

| | | | | | |
|---|---|---|---|---|---|
| 4,191,317 | A | * | 3/1980 | Harkins | 225/77 |
| 5,135,146 | A | | 8/1992 | Simhaee | 225/80 |
| 5,207,367 | A | * | 5/1993 | Dunn et al. | 225/49 |
| 5,213,245 | A | * | 5/1993 | Puaatuua | 225/19 |
| 5,261,585 | A | | 11/1993 | Simhaee | 225/47 |
| 5,292,046 | A | * | 3/1994 | Kaiser et al. | 225/19 |
| 5,433,363 | A | | 7/1995 | Simhaee | 225/47 |
| 5,676,297 | A | * | 10/1997 | Sawyer et al. | 225/21 |
| 5,680,978 | A | * | 10/1997 | Pinion | 225/106 |
| 6,230,953 | B1 | | 5/2001 | Simhaee | 225/46 |
| 6,450,380 | B1 | | 9/2002 | Simhaee | 225/46 |

* cited by examiner

*Primary Examiner*—Charles Goodman
(74) *Attorney, Agent, or Firm*—Peter Ganjian

(57) ABSTRACT

The present invention provides a portable handheld article dispenser comprised of an ergonomically snug grip body for use without the need for permanent attachement of the device to any structure or support surface. The interior of the portable handheld article dispenser comprises a cavity adapted to hold a roll of articles such as plastic bags. The upper section of one axial wall comprises a recessed portion to enable users to rest their thumb for an ergonomic firm grip and a slanted raised edge that provides a frictional surface to prevent the thumb from sliding. The middle portion of the same axial wall enabes the palmar muscles of the thumb to securely rest thereon, and its lower portion curves and comprises of a plurality of parallel grooves (striates) along the length of this edge for a more secure grip when users curl their hand to grip the dispenser. The other axial wall of the exterior comprises of convex portions between two hollow or concave sections that form a wavy contour to allow a user's fingers to rest in the incurvate areas of the waves for a secure and ergonomic grip of the device.

18 Claims, 9 Drawing Sheets

PORTABLE HANDHELD ARTICLE DISPENSER HAVING AN ERGONOMIC SNUG GRIP BODY

BACKGROUND OF THE INVENTION (1) Field of the Invention

The present invention relates to an article dispenser, and more particularly to a portable handheld article dispenser with ergonomic snug grip body.

(2) Description of Related Art

The U.S. Pat. No. 6,450,380 to Simhaee discloses a typical prior art plastic bag dispenser that permanently mounts onto a support structure for proper use. The fastener mechanisms comprise an adhesive pad, and slots through which suitable fasteners such as screws insert to permanently secure the dispenser to a mounting surface. Fixing the dispenser on a support structure compels consumers to dedicate a specific location for its use. Once put into position, regardless of the location of the mounting and the location of the consumers requiring a bag, the consumers must return to the mounted location of the dispenser to retrieve a bag. This is very inconvenient, especially if the distance between the location of the consumer and that of the permanently immovable dispenser is great. To obviate this problem, consumers may simply remove the roll of bags from the dispenser, and use the roll at a location where they need the bags. However, this defeats the purpose of having a dispenser, which is to aid and facilitate separating bags from the roll with ease.

To continue to use dispensers, consumers can purchase several prior art bag dispensers, and permanently affix each to support structures at locations where the bags are mostly used. However, this creates another undesirable effect. In general, the support surfaces to which the dispensers attach tend to damage or alter permanently due to the mounting. This is especially true of kitchen areas where most of the support structures comprise of wood or other easily damageable construction material. Most consumers do not desire and hesitate to permanently alter or damage costly support structures such as kitchen counter-tops, garage walls, or any others for a bag-dispenser that costs much less.

In addition to the above problems, the prior art bag dispensers become somewhat dangerous when the roll of bags thereon partially depletes. As the bags are used up, the outer circumference of the roll reduces, creating a larger and larger distance in space between the tongue of the dispenser and the outer surface of the roll. This large space makes it easy for infants or pets to chew on the tongue, making it dangerous.

BRIEF SUMMARY OF THE INVENTION

The present invention provides a portable handheld article dispenser comprised of an ergonomically snug grip body for use without the need for permanent attachement of the dispenser to any structure or support surface.

The interior of the portable handheld article dispenser comprises a cavity for holding a roll of articles such as plastic bags. The core of the roll loads by sliding it along the recessed grooves located on the interior of each vertical wall until it locks into the cutout apertures located beneath the recessed grooves. The exterior upper section of one axial wall comprises a recessed portion to enable users to rest their thumb for an ergonomic firm grip and a slanted raised edge that provides a frictional surface to prevent the thumb from sliding. The middle portion of the same axial wall enables the palmar muscles of the thumb to securely rest thereon, and its lower portion curves and comprises of a plurality of parallel grooves (striates) along the length of this edge for a more secure grip of the dispenser. The other axial wall of the exterior comprises of convex portions between two hollow or concave sections that form a wavy contour to allow a user's fingers to rest in the incurvate areas of the waves for a secure and ergonomic grip of the device.

The portable handheld article dispenser of the present invention further comprises a dispensing bar with a protrusion (or "lip") to engage with the perforation line of the article dispensed for a clean tear-off of the article. The second axial wall parallel to the dispensing bar comprises a raised section or bump near the top center, directly opposite the lip to create a crease in the article as it dispenses, facilitating the separation of the perforation line of the articles prior to reaching the lip.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention.

Referring to the drawings in which like reference numbers present corresponding parts throughout.

DETAILED DESCRIPTION OF THE INVENTION

Figure 1:
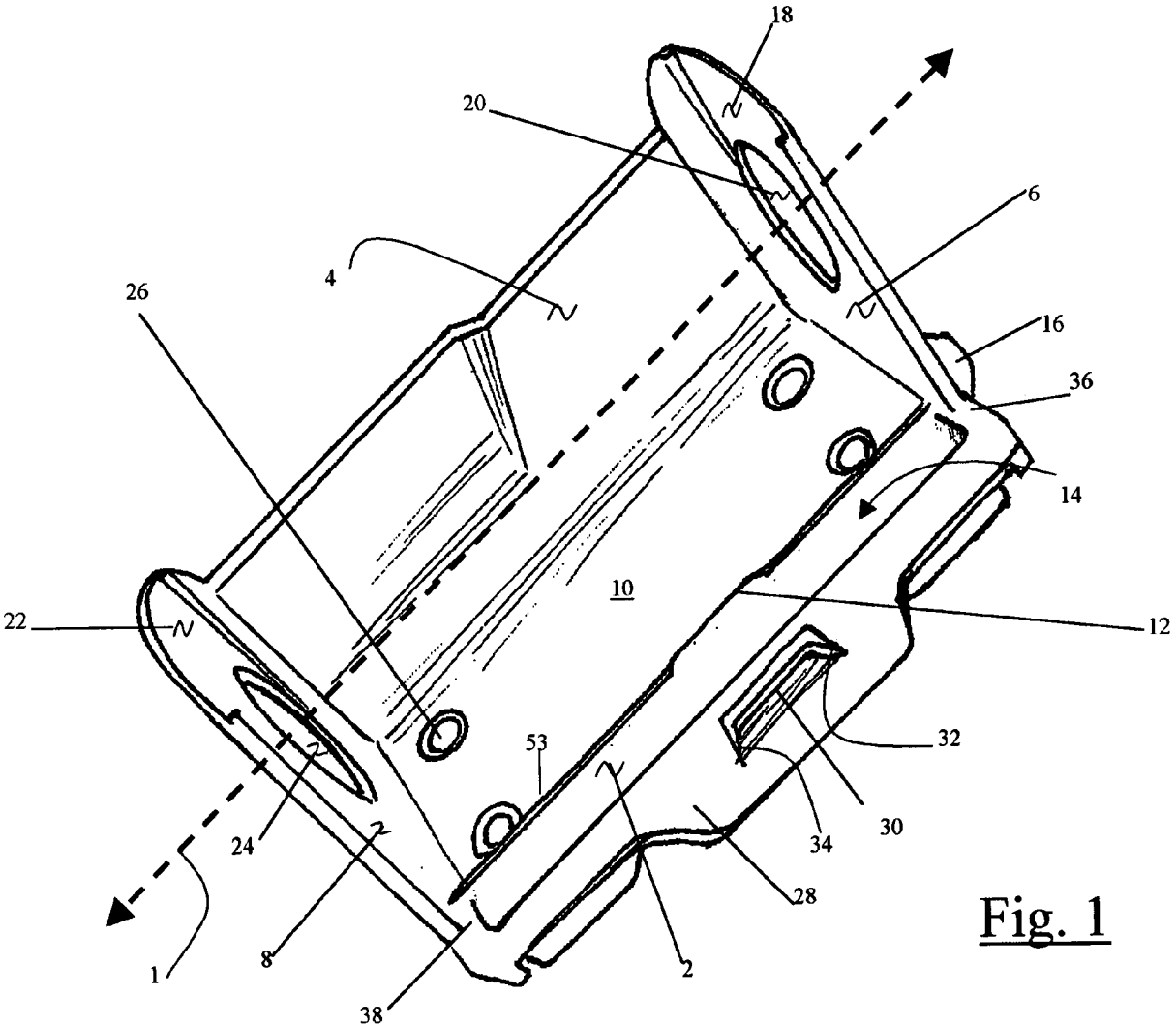
FIG. 1 is an exemplary top perspective view of a portable handheld dispenser in accordance with the present invention.
Figure 2:
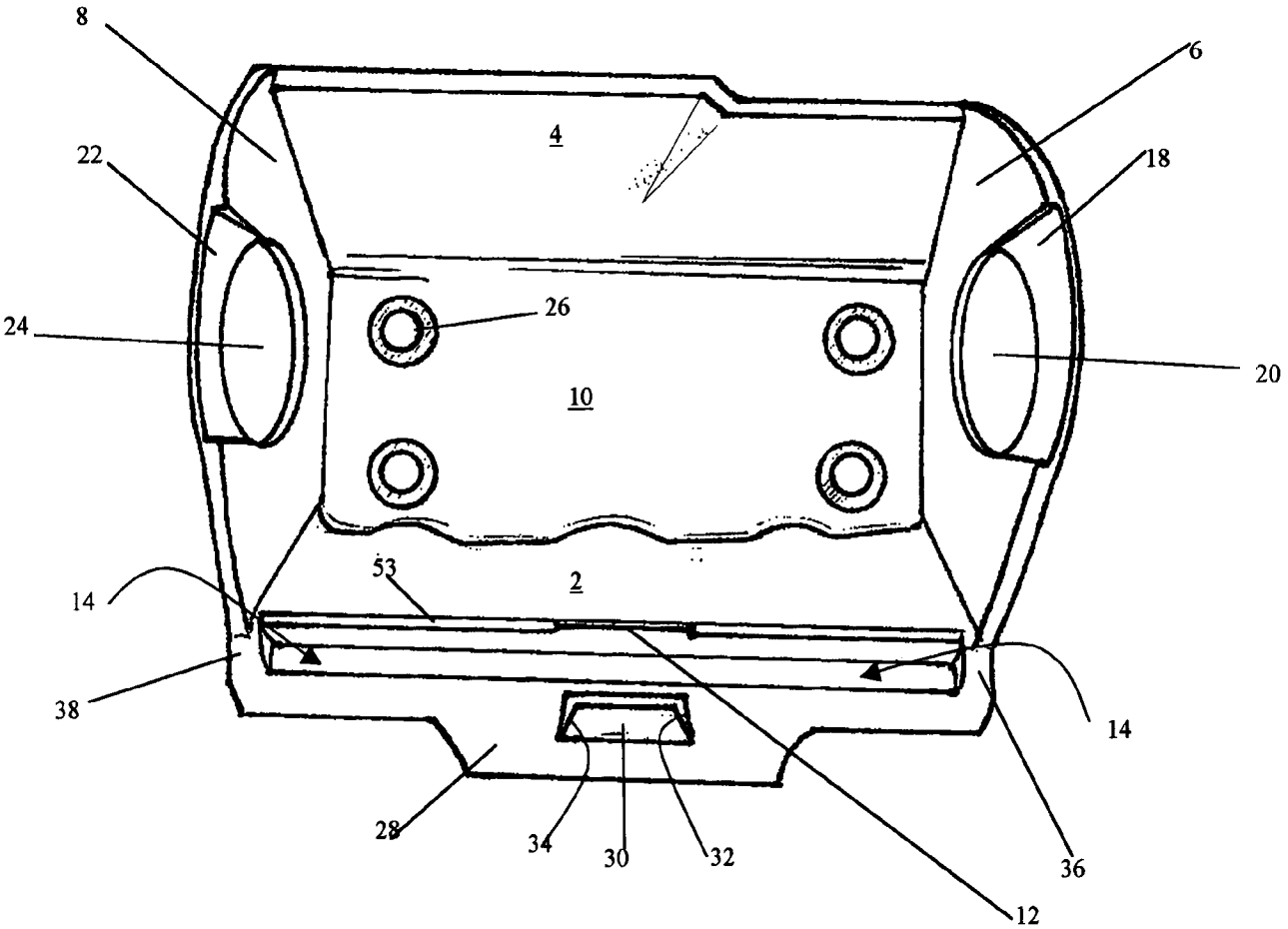
FIG. 2 is an exemplary top plan view of the dispenser illustrated in FIG. 1.

FIG. 1 is an exemplary perspective view of a portable handheld article dispenser in accordance with the present invention, and FIG. 2 is the exemplary top plan view of the dispenser illustrated in FIG. 1. The article dispenser molded as a single unitary piece from a suitable material comprises a first axial wall 2 and a second axial wall 4 along the axis 1 of the dispenser, and a bottom 10 and two vertical side walls 6 and 8 to form a cavity. The first and the second axial walls 2 and 4 slope towards each other near the bottom 10, forming an almost syncline (V-shaped) depression. Hence, both axial walls 2 and 4 converge slightly near the bottom 10, with the distance between them at their upper portion being greater than that of their lower section.

As further illustrated in FIGS. 1–4, integral with the top section of the first axial wall 2 is a dispenser bar 28, supported through integral extensions 36, 38 to create a gap 14 whereby the article is to flow through as part of the dispensing process. The dispenser bar 28 is wider in the middle portion and includes a partially cutout trapezoid area to form a trapezoid liplike protrusion 30. The trapezoid lip 30 is integral with the bar 28 in a cantilever-like manner, i.e. the longer of the two parallel sides of the trapezoid lip 30 is integral with the bar 28, and the other three sides are free (cut-away from the bar 28). Lip 30 is cutout and bent at an angle towards the bottom 10 of the dispenser to facilitate separating the individual articles as they unroll.

Figure 3:
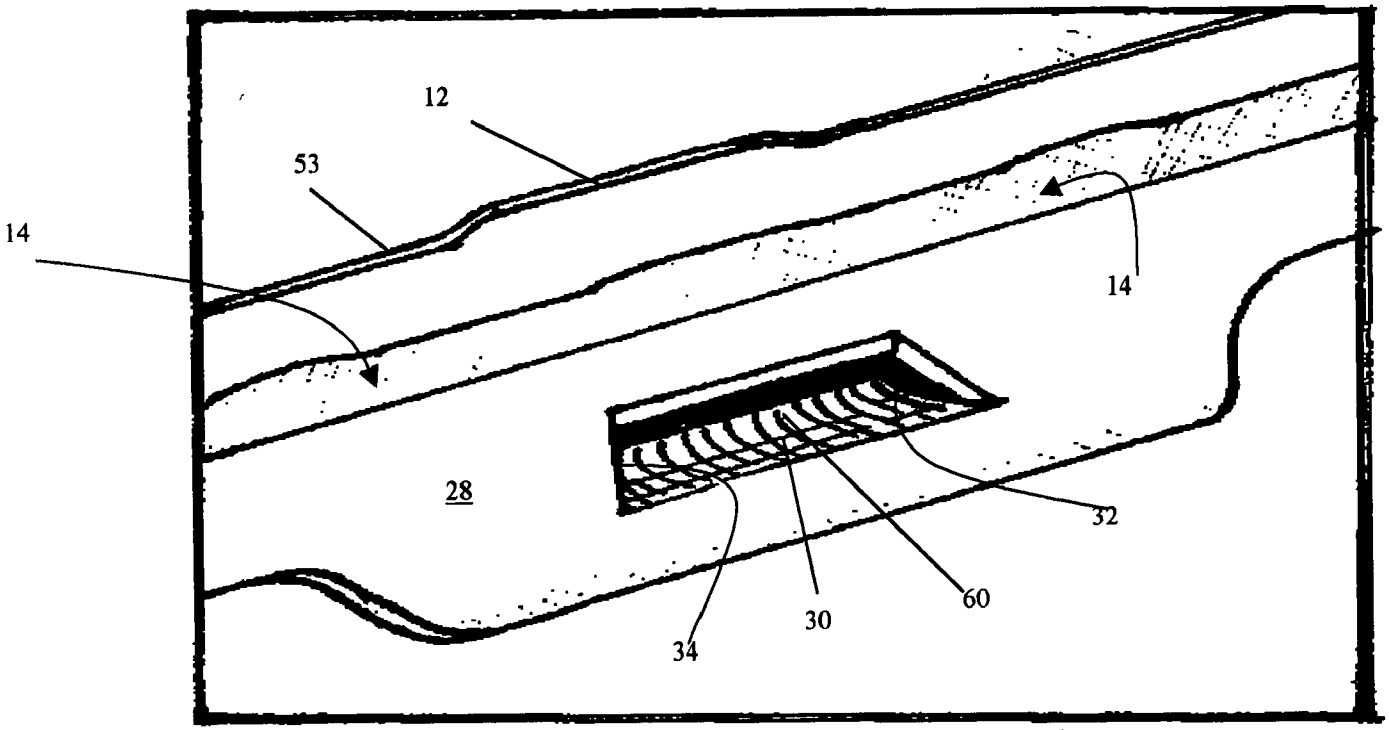
FIG. 3 is an exemplary enlarged view of a section of a dispenser bar in accordance with the present invention.
Figure 4:
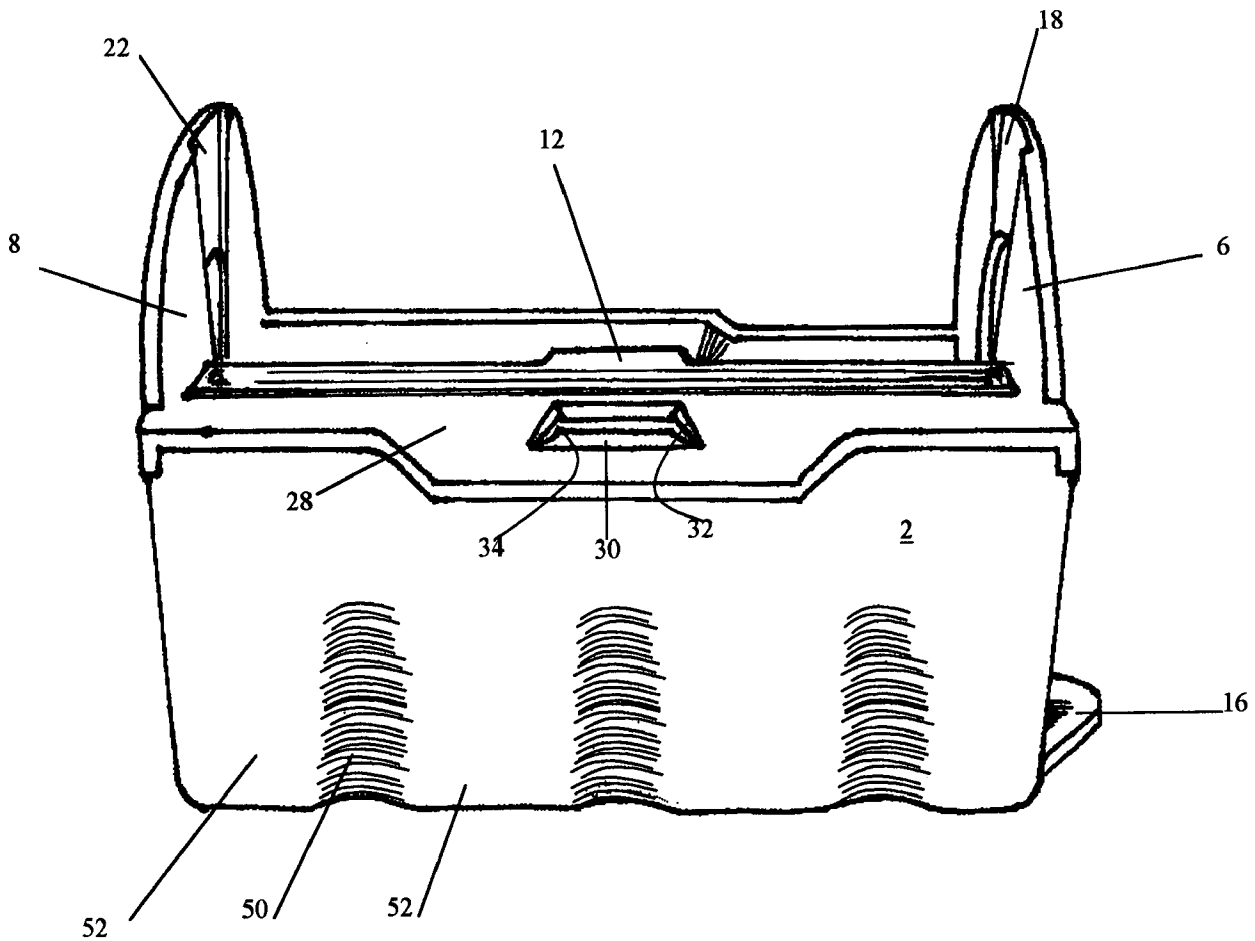
FIG. 4 is an exemplary plan view of the first axial wall along the axis of the dispenser illustrated in FIG. 1.

As better illustrated in FIG. 3, the downward protruding trapezoid lip 30 is not a straight slope, but curves down and then up proximal to its free parallel edge 60, forming a hook like incurvate structure. The free parallel edge 60 of the protruding trapezoid lip 30 curved upward captures the perforated lines at the ends of each article and holds the next article in place until the current article dispenses. The next article is held in place (captured) by crevasses 32 and 34 at both ends of the non-parallel sides of the trapezoid opening of the dispensing bar 28, and stopped by the parallel edge of the lip 30 integral with bar 28. This also ensures that the next article in succession is easily accessible for dispensing. The positioning of the lip 30 securely under the dispensing bar 28 poses no danger to infants or pets—which have a habit of chewing on everything.

As further illustrated in FIGS. 1–4, the top edge 53 of the first axial wall 2 comprises a bump 12, which functions to create a crease on the proximal end of each article (shown in FIG. 9) as they dispense. When the perforation line located at the end of the article reaches the bump 12, they automatically begin to separate as they go over it before reaching the liplike protrusion 30 located on the dispenser bar 28. Therefore, the bump 12 ensures that the articles are semi-separated at their perforation line before the lip 30 engages therewith, ensuring a clean tear-off. As further illustrated in FIG. 4, the wall 2 further comprises of convex portions 52 between two hollow or concave sections 50 that form a wavy contour to allow a user's fingers to rest in the incurvate areas of the waves for a secure and ergonomic grip of the device. In general, their height measured from bottom 10 to near the top edge 53 cover about two thirds of an average person's finger's height.

Referring back to FIGS. 1–2, the interior of the first vertical wall 6 and the second vertical wall 8 comprise of channels 18, 22, respectively, to facilitate and guide the insertion of a roll of articles. Each of the grooves 18, 22 are wider at the top, and narrow proximal the respective apertures 20 and 24 located at near the center of the vertical walls 6 and 8. In loading the roll, the axis of its cylindrical core (not shown) is held in parallel with the axis 1 of the dispenser and pushed towards bottom 10, with the two core-ends pressed against the channels 18, 22 until the core snaps into the holes 20 and 24 when fully inserted. It is preferred that the roll is inserted into the cavity in such a manner so that it unrolls when the core rotates counter-clockwise towards the second axial wall 4, when holding the dispenser with the first vertical wall 6 away from one's body. That is, the partially unrolled edge of the article unrolls from underneath (rather than the top) of the core, and can rest on the top edge of the first axial wall 2, with the article looping over the elevated protrusion or bump 12 thereon, through a gap 14, under the dispensing bar 28, then out. The bottom 10 of the dispenser is in general rectangular, and comprises a number of holes 26 beveled from the surface thereof to allow for optional mounting of the dispenser on to a support surface.

Figure 5:
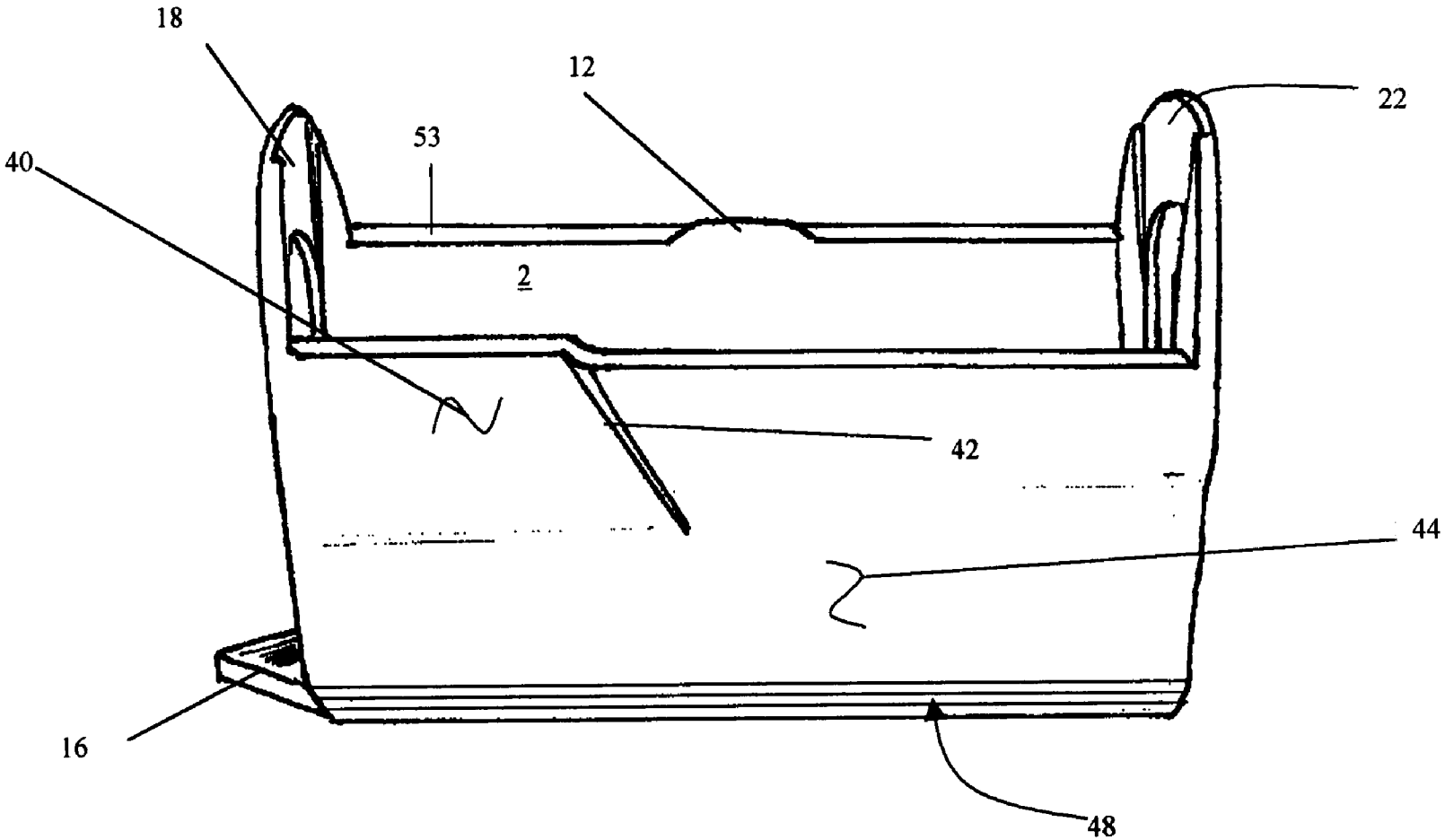
FIG. 5 is an exemplary plan view of the second axial wall along the axis of the dispenser illustrated in FIG. 1.
Figure 6:
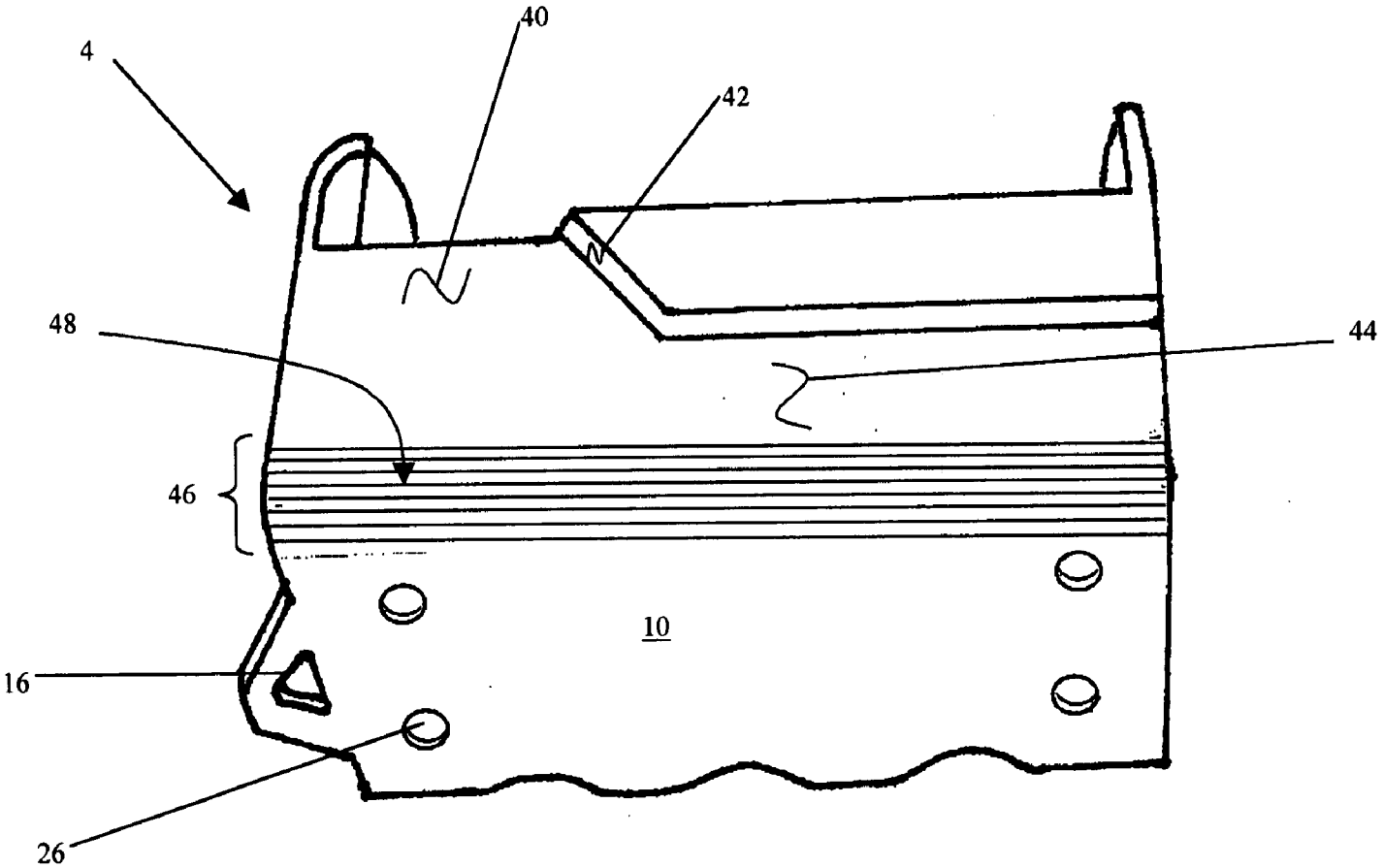
FIG. 6 is an exemplary perspective view of the second axial wall along the axis of the dispenser illustrated in FIG. 1.

FIGS. 5 and 6 are exemplary plan and perspective views of the second axial wall 4 and dispenser bottom 10 along the axis 1 of the dispenser illustrated in FIG. 1. As illustrated, the upper section of the second axial wall 4 comprises a recessed or sunken portion 40 proximal to the first vertical wall 6 to enable users to rest their thumb for an ergonomic firm grip of the dispenser when used, and a slanted raised edge 42 that provides a frictional surface to prevent the thumb from sliding. The middle portion 44 of wall 4 enables the palmar muscles of the thumb to securely rest thereon, and its lower portion 46 (the corner-edge integral with the bottom 10) curves and comprises of a plurality of parallel grooves (striates) 48 along the length of this edge. The lower curved portion 46 touches the incurvate section of the palm when users curl their hand to grip the dispenser. As the users' palm firmly grip this edge, the skin of their palm presses within and fills-in the parallel grooves (striates) 48. The friction created due to the interlocking of skin with the grooves 48 provides for a secure grip. Illustrated is also a hanger or hook 16 near the bottom 10 at the lower section of the first vertical wall 6 to allow users to hang (not permanently attach) the dispenser on a hook, nail, or other hanging devices.

Figure 7:
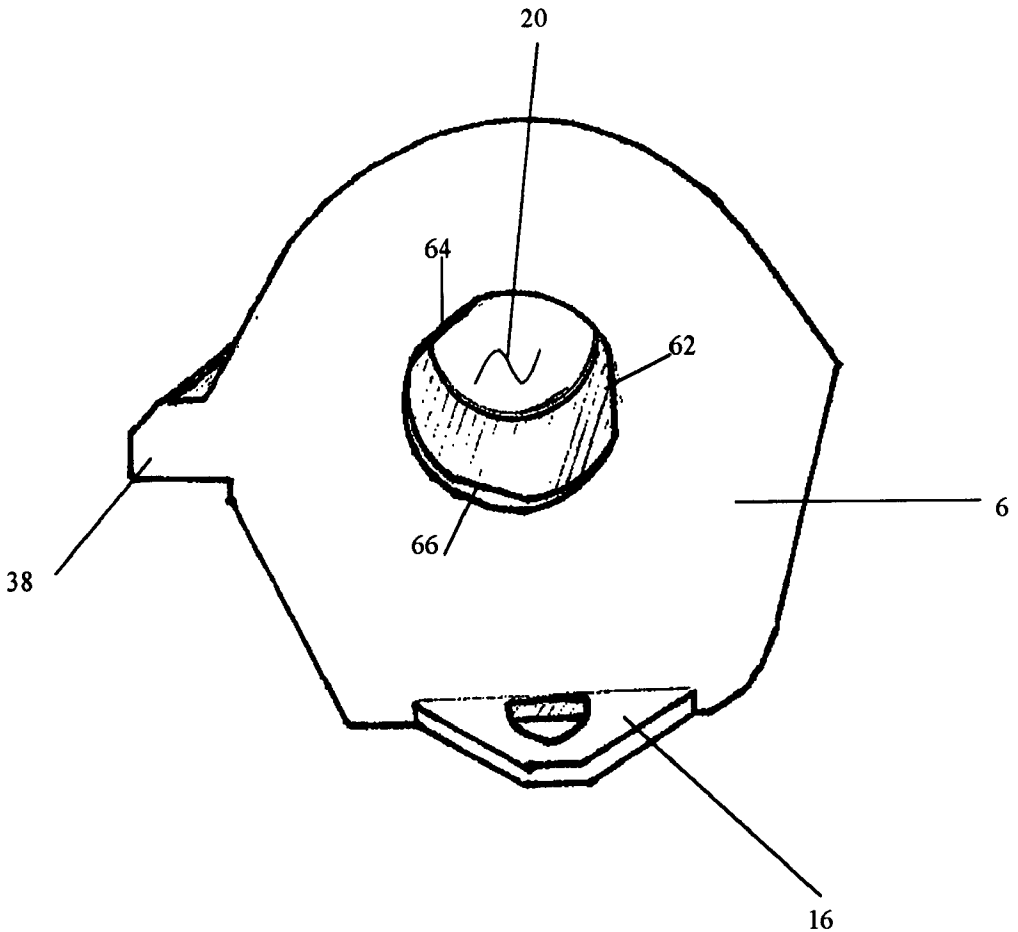
FIG. 7 is an exemplary plan view of a first vertical wall of the dispenser illustrated in FIG. 1.
Figure 8:
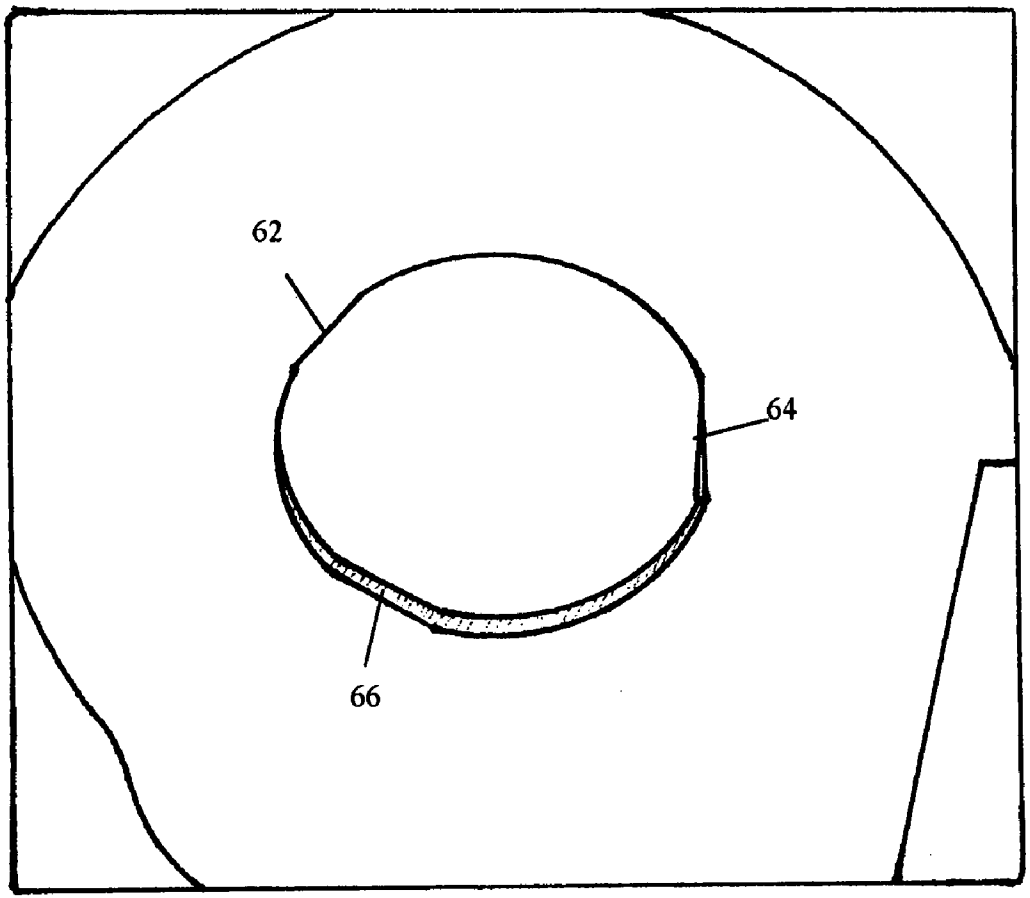
FIG. 8 is an exemplary enlarged view of an aperture for holding a cylindrical core of a roll of articles in accordance with the present invention.

FIG. 7 illustrates the first vertical wall 6, including a semi-circular opening 20 near the center thereof. Integral with and proximal to the lower section of the first vertical wall 6 is the hanger 16 that allows users the option of hanging the portable handheld article dispenser when not in use. As better illustrated in FIG. 8, the semi-circular hole 20 (and its counter-part 24 on the second vertical wall 8) hold the core (not shown) of a roll of articles. The circumference of each semi-circular aperture 20 and 24 includes three flat edges (areas) 62, 64, and 66 that function as brakes to stop the reverse free spin of the core as articles dispense therefrom. Hence, the flats 62, 64, and 66 slow and stop the rotation of the core as a result of friction between the round cylindrical edges of the core and the straight sections or edges of the holes 22, 24.

Figure 9:
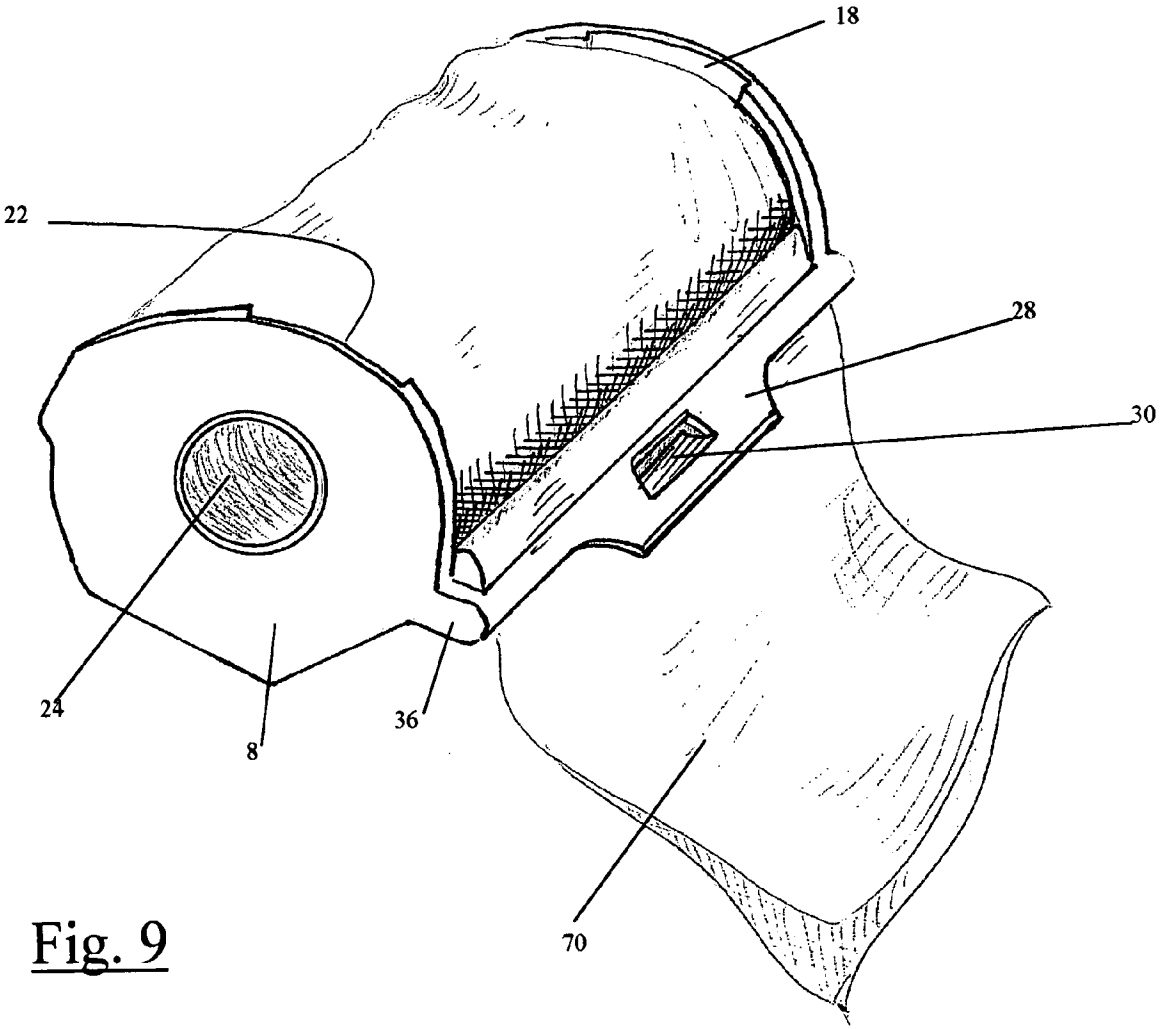
FIG. 9 is an exemplary perspective view of the dispenser illustrated in FIG. 1, loaded with a roll of articles.

FIG. 9 is an exemplary perspective view of the dispenser illustrated in FIG. 1, loaded with a roll of articles 70. As illustrated, the roll of articles 70 inserts through channels 18, 22, with its core held within apertures 20, 24 of the first and second vertical walls 6 and 8 when its core is fully inserted. The roll inserts into the cavity in such a manner that the articles 70 unroll from the bottom of the core when it rotates counter-clockwise. That is, the partially unrolled edge of the article 70 rests on the top edge 53 of the first axial wall 2, with the article 70 looping over the elevated protrusion or bump 12, through the gap 14, under the dispensing bar 28, and then out. As the articles 70 dispense, the bump 12 creates a crease in the articles, facilitating the separation of the articles 70 along their respective perforation line to ensure their engagement with the lip 30 on the dispenser bar 28 for a clean separation.

While illustrative embodiments of the invention have been described, numerous variations and alternative embodiments will occur to those skilled in the art. For example, the lip 30 of the dispenser may comprise of a square or other geometry, and is not limited to trapezoid. The articles need not be plastic bags, and in fact can comprise of any rolled material with perforation lines to facilitate the separation of the articles from one another. The cavity of the dispenser may comprise of any appropriate dimension to accommodate a commensurate roll of articles. All of the ergonomic features and functional components (e.g. the dispenser bar, the lip, etc.) of the dispenser could easily be modified so to accommodate right-handed as well as lefthanded users. Such variations and alternate embodiments are contemplated, and can be made without departing from the spirit and scope of the invention.

What is claimed is:

1. A dispenser, comprising:

a portable, integrally molded, ergonomic body having a cavity for accommodating a roll of articles for dispensing;

said portable, integrally molded, ergonomic body is comprised of:

a bottom side;

a first axial wall and a second axial wall parallel to each other and integral with said bottom side for forming a syncline;

a third vertical wall and a fourth vertical wall, integral with said first axial wall and said second axial wall and said bottom side for forming said cavity;

said first axial wall having a first axial wall ergonomic exterior, which is comprised of at least one convex portion between two concave sections for forming a wavy surface, which is contoured for allowing fingers to rest against and grip incurvate sections formed by said concave sections;

said second axial wall having a second axial wall ergonomic exterior, which is comprised of an upper recess portion for resting a thumb, and an upper slanted raised edge to prevent a sliding of said thumb;

said second axial wall ergonomic exterior further comprising a middle section for enabling palmer muscles of a hand to rest against said middle section, and a lower curved section having a plurality of striates along an edge of said second axial wall for allowing a palm of said hand to rest against said lower curved section, pressing against said plurality of striates;

whereby said first axial wall ergonomic exterior and said second axial ergonomic exterior allow for a secure and ergonomic grip of said dispenser.

2. The dispenser as set forth in claim 1, wherein said first axial wall is further comprised of a first axial wall edge that has a first axial wall edge protrusion at a middle section of said first axial wall edge.

3. The dispenser as set forth in claim 2, wherein said first axial wall edge protrusion creates a crease on a perforated line between a current article and a next article as said current article is dispensed, thereby ensuring that said current article is semi-separated at said perforated line from said next article.

4. The dispenser as set forth in claim 3, wherein said first axial wall is further comprised of a dispenser bar integral with an upper section of said first axial wall through integral support extensions that form a gap between said first axial wall edge and said dispenser bar.

5. The dispenser as set forth in claim 4, wherein said dispenser bar is comprised of two distal ends and a middle portion, with said middle portion having a wider cross-sectional area than said two distal ends;

said wider cross-sectional area includes a partially cutout section to form a partial opening, with said cutout section integral with said dispenser bar in a cantilever suspension to form a protrusion that extends from said dispenser bar.

6. The dispenser as set forth in claim 5, wherein said protrusion extends and curves from said dispenser bar downward at an angle, then curves upward, toward a proximal free edge of said protrusion to form an incurvate structure, below a surface of said dispenser bar.

7. The dispenser as set forth in claim 6, wherein said incurvate structure is curved upward at said free end to capture said perforated line at an end of each current article, and stops said next article in place until said current article is dispensed.

8. The dispenser as set forth in claim 7, wherein said next article is stopped in place by crevasses formed at both ends of said protrusion.

9. The dispenser as set forth in claim 8, wherein said third vertical wall is comprised of a third vertical wall interior having a third vertical wall channel and said fourth vertical wall is comprised of a fourth vertical wall interior having a fourth vertical wall channel, with each said third vertical wall channel and said fourth vertical wall channel formed to facilitate and guide an insertion of said roll of articles.

10. The dispenser as set forth in claim 9, wherein each of said third vertical wall and said fourth vertical wall is further comprised of a semi-circular aperture with portions of said semi-circular aperture having flat edges for impeding a reverse free spin of a core of said roll of articles.

11. The dispenser as set forth in claim 1, wherein said first axial wall is further comprised of a first axial wall edge protrusion for creating a crease on a perforated line between a current article and a next article as said current article is dispensed, thereby ensuring that said current article is semi-separated at said perforated line from said next article.

12. The dispenser as set forth in claim 1, wherein said first axial wall is further comprised of a dispenser bar integral with an upper section of said first axial wall through integral support extensions that form a gap between a first axial wall edge and said dispenser bar.

13. The dispenser as set forth in claim 1, wherein said first axial wall is further comprised of a dispenser bar having two distal ends and a middle portion, with said middle portion having a wider cross-sectional area than said two distal ends;

said wider cross-sectional area includes a partially cutout section to form a partial opening, with said cutout section integral with said dispenser bar in a cantilever suspension to form a protrusion that extends from said dispenser bar.

14. The dispenser as set forth in claim 13, wherein said protrusion extends and curves from said dispenser bar downward at an angle, then curves upward, toward a proximal free edge of said protrusion to form an incurvate structure, below a surface of said dispenser bar.

15. The dispenser as set forth in claim 14, wherein said incurvate structure is curved upward at said free end to capture a perforated line at an end of each current article, and stops a next article in place until each said current article is dispensed.

16. The dispenser as set forth in claim 15, wherein said next article is stopped in place by crevasses formed at both ends of said protrusion.

17. The dispenser as set forth in claim 1, wherein said third vertical wall is comprised of a third vertical wall interior having a third vertical wall channel and said fourth vertical wall is comprised of a fourth vertical wall interior having a fourth vertical wall channel, with each said third vertical wall channel and said fourth vertical wall channel formed to facilitate and guide an insertion of said roll of articles.

18. The dispenser as set forth in claim 1, wherein each of said third vertical wall and said fourth vertical wall is further comprised of a semi-circular aperture with portions of said semi-circular aperture having flat edges for impeding a reverse free spin of a core of said roll of articles.

* * * * *